US008956005B2

(12) United States Patent
Thomas et al.

(10) Patent No.: US 8,956,005 B2
(45) Date of Patent: Feb. 17, 2015

(54) LOW-PROFILE ELONGATED LED LIGHT FIXTURE

(75) Inventors: James Thomas, Tierra Verde, FL (US); Vladimir Volochine, Safety Harbor, FL (US)

(73) Assignee: Electraled, Inc., Largo, FL (US)

( * ) Notice: Subject to any disclaimer, the term of this patent is extended or adjusted under 35 U.S.C. 154(b) by 543 days.

(21) Appl. No.: 12/587,559

(22) Filed: Oct. 7, 2009

(65) Prior Publication Data

US 2010/0103672 A1 Apr. 29, 2010

Related U.S. Application Data

(63) Continuation-in-part of application No. 11/821,793, filed on Jun. 25, 2007.

(60) Provisional application No. 61/195,399, filed on Oct. 7, 2008, provisional application No. 60/187,913, filed on Jun. 30, 2006.

(51) Int. Cl.

| | |
|---|---|
| ***F21V 21/00*** | (2006.01) |
| ***F21S 4/00*** | (2006.01) |
| ***F21V 15/01*** | (2006.01) |
| ***F25D 27/00*** | (2006.01) |

(Continued)

(52) U.S. Cl.

CPC ..... *F21S 4/008* (2013.01); *F21V 15/013* (2013.01); *F25D 27/00* (2013.01); *F21V 15/015* (2013.01); *F21W 2131/305* (2013.01); *F21W 2131/405* (2013.01); *F21Y 2101/02* (2013.01); *F21Y 2103/003* (2013.01)

USPC ..... 362/217.12; 362/217.1; 362/217.11; 362/217.13; 362/217.14; 362/217.15; 362/217.16; 362/217.17

(58) Field of Classification Search

USPC ..... 362/217.01–217.17, 218–225

See application file for complete search history.

(56) References Cited

U.S. PATENT DOCUMENTS

| | | | |
|---|---|---|---|
| 3,936,686 | A | 2/1976 | Moore |
| 4,143,411 | A | 3/1979 | Roberts |

(Continued)

FOREIGN PATENT DOCUMENTS

| | | |
|---|---|---|
| JP | 3142490 | 6/2008 |

OTHER PUBLICATIONS

PCT/US2009/005506 International Search Report and Written Opinion of the International Searching Authority Mailed: May 12, 2010.

*Primary Examiner* — William Carter

(74) *Attorney, Agent, or Firm* — McDermott Will & Emery LLP

(57) ABSTRACT

The invention provides an elongated lighting fixture with multiple light emitting diodes (LEDs) arrayed in two groups that are angled to each other. The fixture provides an extremely broad light emitting angle and includes an elongated housing having a pair of side walls. Each side wall has a support member extending upward at angle from the side wall, wherein the side walls terminate at a central wall. A generally transparent cover is connected to the housing and extends between opposed ends of the housing. A first group of LEDs and a second group of LEDs are mounted to the first support member and the second support member, respectively. PCB boards assemblies are affixed to respective support members beneath the group of LEDs by tension clips. When the PCBs are energized by a power source, current travels from the PCBs to each LED for illumination.

20 Claims, 6 Drawing Sheets

(51) Int. Cl.

| | |
|---|---|
| *F21V 15/015* | (2006.01) |
| *F21W 131/305* | (2006.01) |
| *F21W 131/405* | (2006.01) |
| *F21Y 101/02* | (2006.01) |
| *F21Y 103/00* | (2006.01) |

(56) References Cited

U.S. PATENT DOCUMENTS

| | | | | |
|---|---|---|---|---|
| 4,149,217 | A | 4/1979 | Tucker | |
| 4,416,411 | A | 11/1983 | Desmond et al. | |
| 4,612,206 | A | 9/1986 | Shimozato et al. | |
| 4,612,606 | A | 9/1986 | Roberts | |
| 4,720,773 | A | 1/1988 | Ahroni | |
| 4,855,882 | A | 8/1989 | Boss | |
| 4,908,743 | A | 3/1990 | Miller | |
| 5,015,918 | A | 5/1991 | Copeland | |
| 5,103,382 | A | 4/1992 | Kondo et al. | |
| 5,222,799 | A | 6/1993 | Sears et al. | |
| 5,499,170 | A * | 3/1996 | Gagne | 362/223 |
| 5,526,236 | A | 6/1996 | Burnes et al. | |
| 5,607,227 | A | 3/1997 | Yasumoto et al. | |
| 5,697,175 | A | 12/1997 | Schwartz | |
| 5,746,497 | A | 5/1998 | Machida | |
| 5,857,767 | A | 1/1999 | Hochstein | |
| 5,892,192 | A | 4/1999 | Ishiguro et al. | |
| 5,924,785 | A | 7/1999 | Zhang et al. | |
| 5,931,577 | A | 8/1999 | Ishibashi | |
| 6,045,240 | A | 4/2000 | Hochstein | |
| 6,072,280 | A | 6/2000 | Allen | |
| 6,116,748 | A | 9/2000 | George | |
| 6,137,648 | A | 10/2000 | Higurashi | |
| 6,183,104 | B1 | 2/2001 | Ferrara | |
| 6,244,728 | B1 | 6/2001 | Cote et al. | |
| 6,283,612 | B1 | 9/2001 | Hunter | |
| 6,346,777 | B1 | 2/2002 | Kim | |
| 6,350,039 | B1 | 2/2002 | Lee | |
| 6,371,637 | B1 | 4/2002 | Atchinson et al. | |
| 6,394,626 | B1 | 5/2002 | McColloch | |
| 6,396,466 | B1 | 5/2002 | Pross et al. | |
| 6,416,200 | B1 | 7/2002 | George | |
| 6,431,728 | B1 | 8/2002 | Fredericks et al. | |
| 6,573,536 | B1 | 6/2003 | Dry | |
| 6,578,979 | B2 | 6/2003 | Truttmann-Battig | |
| 6,578,986 | B2 | 6/2003 | Swaris et al. | |
| 6,617,520 | B1 | 9/2003 | Martter et al. | |
| 6,641,283 | B1 | 11/2003 | Bohler | |
| 6,665,170 | B1 | 12/2003 | Warner et al. | |
| 6,712,486 | B1 | 3/2004 | Popovich et al. | |
| 6,815,724 | B2 | 11/2004 | Dry | |
| 6,831,303 | B2 | 12/2004 | Dry | |
| 6,846,093 | B2 | 1/2005 | Swaris et al. | |
| 7,114,831 | B2 | 10/2006 | Popovich et al. | |
| 7,121,675 | B2 | 10/2006 | Ter-Hovhannisian | |
| 8,201,977 | B2 | 6/2012 | Thomas et al. | |
| 2001/0015891 | A1 | 8/2001 | Suzuki et al. | |
| 2003/0218878 | A1 | 11/2003 | Swaris et al. | |
| 2005/0265019 | A1 * | 12/2005 | Sommers et al. | 362/217 |
| 2007/0047229 | A1 * | 3/2007 | Lee | 362/237 |
| 2007/0159820 | A1 * | 7/2007 | Crandell et al. | 362/249 |
| 2008/0007945 | A1 | 1/2008 | Kelly et al. | |
| 2010/0103672 | A1 | 4/2010 | Thomas et al. | |

* cited by examiner

LOW-PROFILE ELONGATED LED LIGHT FIXTURE

CROSS-REFERENCE TO RELATED APPLICATIONS

This Application claims the benefit of U.S. Provisional Application No. 61/195,399, filed Oct. 7, 2008, and is a continuation-in-part of prior U.S. patent application Ser. No. 11/821,793, filed on Jun. 25, 2007, which claims the benefit of U.S. Provisional Application No. 60/187,913, filed Jun. 30, 2006.

FEDERALLY SPONSORED RESEARCH OR DEVELOPMENT

Not applicable.

TECHNICAL FIELD

The invention relates to an elongated lighting fixture with multiple light emitting diodes (LEDs) arrayed in two distinct angular positions. The fixture includes an elongated housing with two angled support members to which an array of LED modules are mounted, a circuit board affixed to a surface of each support member, a cover, and a power supply. The fixture may also include remote operations capability.

BACKGROUND OF THE INVENTION

There currently exists a number of lighting fixtures utilizing LEDs as the light source. While such fixtures provide some beneficial features, they nevertheless suffer from a number of limitations, including but not limited to, uneven light distribution and brightness, high material and component costs, difficult and time-consuming assembly, and cumbersome housing configurations that hamper installation and thus prevent custom applications. An example of a lighting fixture suffering from the above limitations is disclosed in U.S. Pat. No. 6,283,612. There, the fixture comprises a hollow tube 20 with a single, linear array of LEDs 44 extending from a printed circuit board 22, along with a plurality of resistors 38. The bottom 26 of the board 22 has a full length conductive bus 28 and a full length conductive negative bus 30, with each bus 28, 30 located adjacent an opposed outside edge of the board 22. The anode 46 of the LED 44 is in communication with a second lead 42 of one of the resistors 38, and the cathode 48 is in communication with an adjacent LED 44 connected in series. A pair of end caps 50 are hermetically sealed to the tube 20 with adhesive 54 to secure the circuit board 22 within the tube 20, where the end caps 50 have a bore 56 that accept a cord 60. A resilient gasket 58 is disposed between the circuit board 22 and each end cap 50 to further secure the circuit board 22 within the hollow tube 20. An external power supply 64 provides direct current power to the single array of LEDs 44. A U-shaped mounting bracket 66 is utilized to mount the tube 20 for installation. Because the LEDs 44 are linearly arranged in a single plane, the tube 20 produces a limited range of light that is uneven and susceptible to undesirable "hot spots." This poor lighting performance renders the tube 20 commercially unfeasible.

Further, refrigerated display cases, often referred to as coolers or freezers, are commonly found in grocery stores, markets, convenience stores, liquor stores and other retail businesses for the preservation and display of food and beverages. Conventional display cases comprise an inner refrigerated space defined by a collection of structural elements, and an opening further defined by the structural elements that is accessible by a sliding or swinging door. Typically, the door is formed from a plurality of frame members that support at least one layer of glass and a handle. The collection of structural elements that form the display case include interior and exterior frame members, including "mullions" which are vertical elements that extend between upper and lower frame members. An end mullion is a peripheral vertical element that is located at one end of the display case, and a center mullion is a central vertical element that is located between two openable doors. The mullion provides an engaging surface for the door seals that are used to maintain the lower temperature within the display case. As such, the mullion is part of a door frame sealing system for the free-standing display case.

Certain retail businesses, such as convenience and liquor stores, include a "walk-in" cooler or room instead of a free-standing refrigerated display case. These walk-in coolers are not free-standing as recognized within the industry, however, they include a number of similar components including mullions and openable doors with seals.

Regardless of whether the refrigerated case is free-standing or walk-in, the door frame members and the door glass conduct ambient heat into the display case and function as a condensation surface for water vapor present in the ambient air.

The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention is directed to a lighting fixture having two groups or arrays of LED modules that are angularly positioned to each other to produce a broad range of illumination. The fixture includes an elongated housing with angled support members, a group of LEDs mounted to each support member, opposed end walls, a top post, and a multiple cover sections that couples to the housing and extends between the end walls and the top post. A circuit board is energized by a external power supply and is positioned along the length of the fixture in connection with the support members. Current flows through the circuit board using a copper trace to illuminate the LED thereon. Because the support members are angularly oriented, the two groups of LEDs are similarly angled. The angled orientation of the two LED groups increase the light distribution angle of the fixture, thereby increasing the lighting performance of the fixture. According to an aspect of the invention, the fixture includes a radio frequency control unit that allows an operator to remotely control the fixture or group of fixtures, including turning the fixtures on, off, or dimming the brightness of the fixtures.

Due to the angled mounting of the two groups of LED modules, the fixture's light emitting angle is significantly greater than conventional fixtures having LEDs arrayed in a single plane. In addition to having a broader light emitting angle and light pattern, the fixture has a longer service life, is more durable and operates more efficiently, both electrically and thermally, than conventional light fixtures including neon, fluorescent, cold cathode, halogen, high-pressure sodium, metal halide, and incandescent. The LED modules increase the utility of the fixture for cold temperature applications, since cold temperatures extend the operating life of the LEDs. Along these lines, the fixture is especially well-suited for use in coolers and freezers, including open-top versions and those with doors, and cold food lockers. The fixture can also be used as original equipment or retrofit in connection with product displays and racks, backlighting, and indirect or ambient applications, regardless of the temperature environment. For example, the fixture can be configured for indirect architectural use, such as a cove fixture in retail stores.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
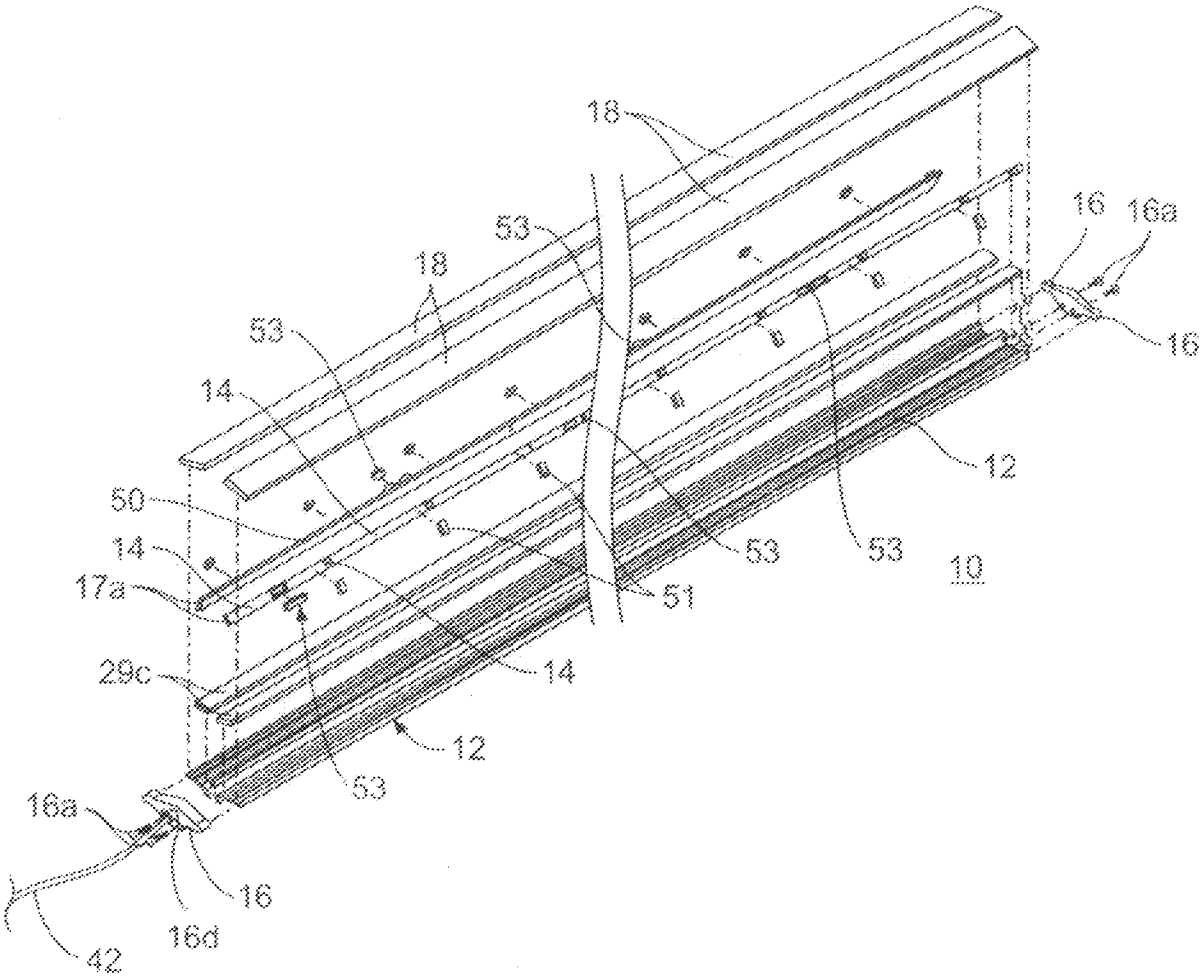
FIG. 1 is an exploded view of a light fixture of the invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
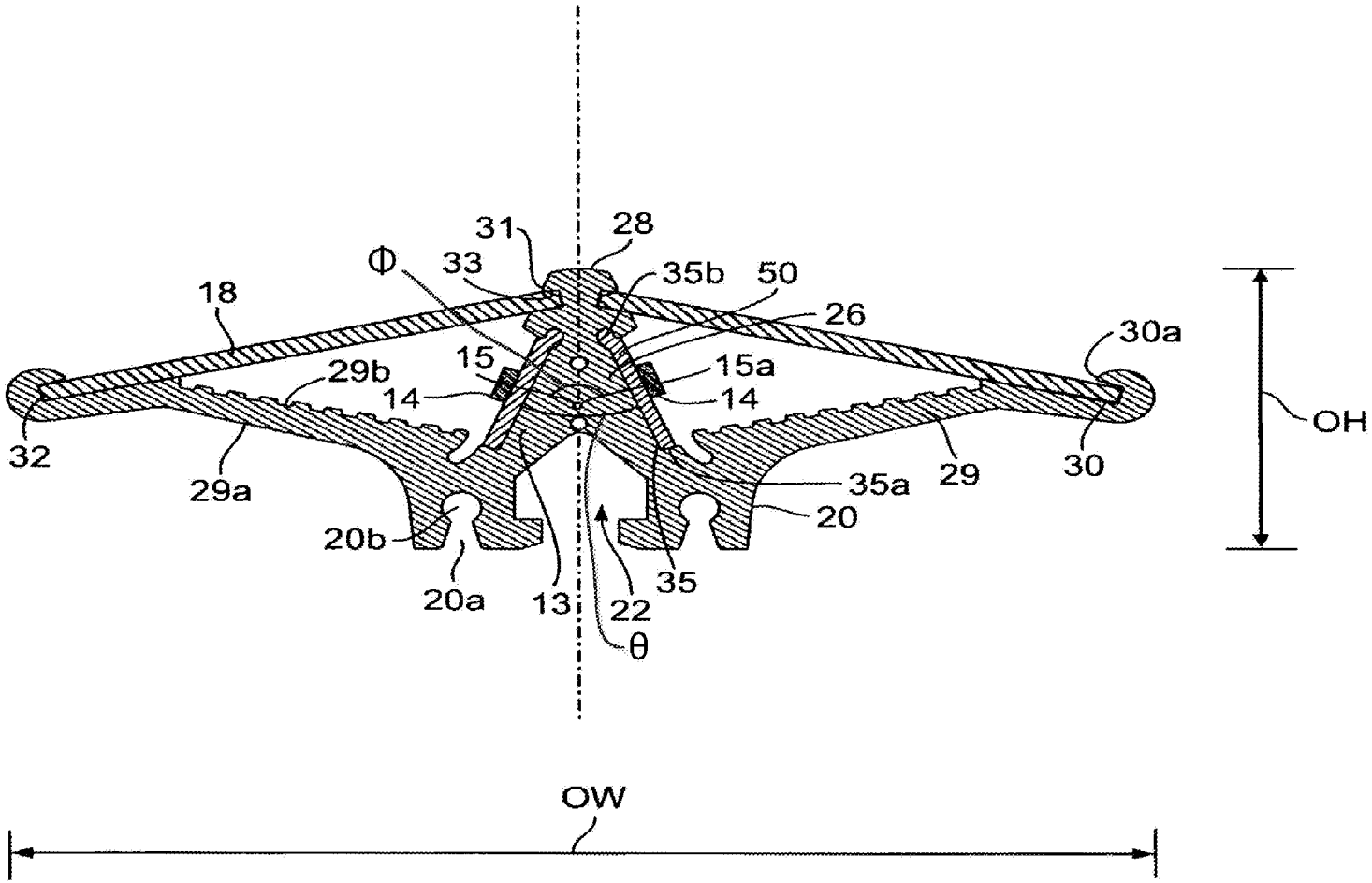
FIG. 2 is a sectional view of a frame of the light fixture, showing a pair of angled support members extending upward to form a peak.

FIGS. 1-2 show an LED illuminated support fixture 10 of the present invention that is configured to be secured to an existing frame member or mullion within a display case or walk-in cooler, in a retrofit manner. Conventional refrigerated display cases are disclosed in U.S. Pat. Nos. 6,637,093 and 6,606,833. The fixture 10 comprises an elongated housing or frame 12, at least two light emitting diodes (LEDs) 14 electrically and mechanically connected to a printed circuit board (PCB) 50, angularly mounted within the frame 12, opposed end caps 16, and generally transparent cover portions 18 that couple to the frame 12 and extend between the end caps 16. As explained in greater detail below, the fixture 10 includes two groups of uniquely positioned LEDs 14 that improve the operating performance of the fixture 10 while lowering the material and assembly costs of the fixture 10. As shown in FIG. 1, the fixture 10 includes multiple PCBs 50 electrically joined inline by a connector 53. Since the support fixture 10 of FIGS. 1-2 includes symmetric arms 29 to evenly distribute light from left to right, it is configured to be joined to a center mullion or support frame. Due to the inclined span of the arms 29, the frame 12 has a "low-profile" configuration with an overall height OH (see FIG. 2), which is the distance between the uppermost surface of the central post 28 and the lowermost surface of the rear legs 20, that is 0.8 to 1 inch, preferably 0.8 to 0.9 inch, and most preferably 0.85 inch. Also, due to the span of the arms 29, the frame 12 has an overall width OW (see FIG. 2), which is the distance between the outermost surface of the curvilinear receivers 30, of 2 to 3 inches, preferably 2.5 to 3 inches, and most preferably 2.75 inches. Thus, the aspect ratio, meaning the ratio of the most preferred width to height of the fixture 12 is 2.75:0.85 or 3.23, which facilitates installation of the fixture 10 without interfering with the operation of a display case.

Referring to the sectional view of FIG. 2, the frame 12 includes at least one rear leg 20 and has a recess 20*a* configured to receive and/or engage an existing frame member or mullion within the display case. The rear legs 20 extend from a central region 13 of the frame 12. The central region 13 includes angled support member or rib 26. Described in a different manner, the angled support member 26 extends upward from the central region 13 above each rear leg 20. The support members 26 converge at the central post 28, which defines an uppermost extent of the frame 12. The rear legs 20 are spaced a distance apart to define a generally U-shaped central cavity 22 that extends longitudinally along the length of the frame 12. The central cavity 22 is designed to receive a fastener or projection of the frame member or mullion to enable coupling of the fixture 10 thereto. Preferably, the frame 12 is a unitary element wherein the rear legs 20, the support members 26 and the central post 28 define a single, integral frame 12 that is preferably extruded from aluminum. Alternatively, the rear legs 20, the support members 26 and/or the central post 28 are separate pieces that are joined, for example by weldment, to form the frame 12. The support members 26 define an internal arrangement angle θ that ranges from 30 to 100 degrees, preferably 45 to 75 degrees and most preferably 60 degrees. As explained below, the arrangement angle θ of the support members 26 relates to the angular positioning of the LEDs 14. Described in a different manner, the first support member 26 resides in a first plane and the second support member 26 reside in a second plane, wherein the first and second planes are angled in a manner that corresponds to the internal arrangement angle θ. A vertical center line CL (see FIG. 2) bisects the central post 28 and separates the frame 12 into two halves. Therefore, the frame 12 is symmetric about the center line CL.

Extending from each angled support member 26, the frame 12 has a pair of opposing arms 29 that extend from the central region 13. Each arm 29 includes a curvilinear lower surface 29*a* and an upper surface 29*b*, the latter of which provides a reflecting surface for light generated by the LEDs 14 through the cover 18 and into the refrigerated space in order to evenly illuminate the food and/or beverage products therein. The upper arm surface 29*a* has a notched surface to facilitate the connection with a reflecting surface 29*c*, including a mirror panel. The upper arm surface 29*a* and the reflecting surface 29*c* are angularly oriented in a range of 0 to 60 degrees from horizontal, and is preferably 10-15 degrees from horizontal, and most preferably 12 degrees from horizontal. At an upper end portion or terminus, each arm 29 includes a curvilinear receiver 30 that receives a first edge 32 of a lens cover 18. The center post 28 includes a second recess 31 that receives a second edge 33 of the lens cover 18 for securement of the cover 18 to the frame 12. In this manner, the both lens covers 18 depend downwardly at an angle from the center post 28. Preferably, the curvilinear receiver 30 of the arm 29 and the second recess 31 of the top post 28 extend longitudinally along the length of the frame 12. The curvilinear receiver 30 is defined by a curvilinear flange 30*a* of the arm 29. As shown in FIG. 2, the central post 28 defines the uppermost component of the fixture 10, wherein all other components reside below the post 28. The receiver 30 vertically resides below the recess 33 of the post 28 and above the uppermost extent 20*b* of the recess 20*a*. Preferably, the frame 12 is an aluminum extrusion and the lens cover 18 is U.V. stabilized polycarbonate. A polycarbonate cover 18 provides electrical isolation for the internal components, including the LEDs 14, while allowing most of the light energy produced by the LEDs to pass through the cover 18. The cover 18 may be clear, diffused, or colored depending upon the desired lighting results. In one preferred embodiment, the frame 12 has an overall length of approximately 60 inches, and the cover 18 has a thickness of approximately 0.050 inch.

Figure 3:
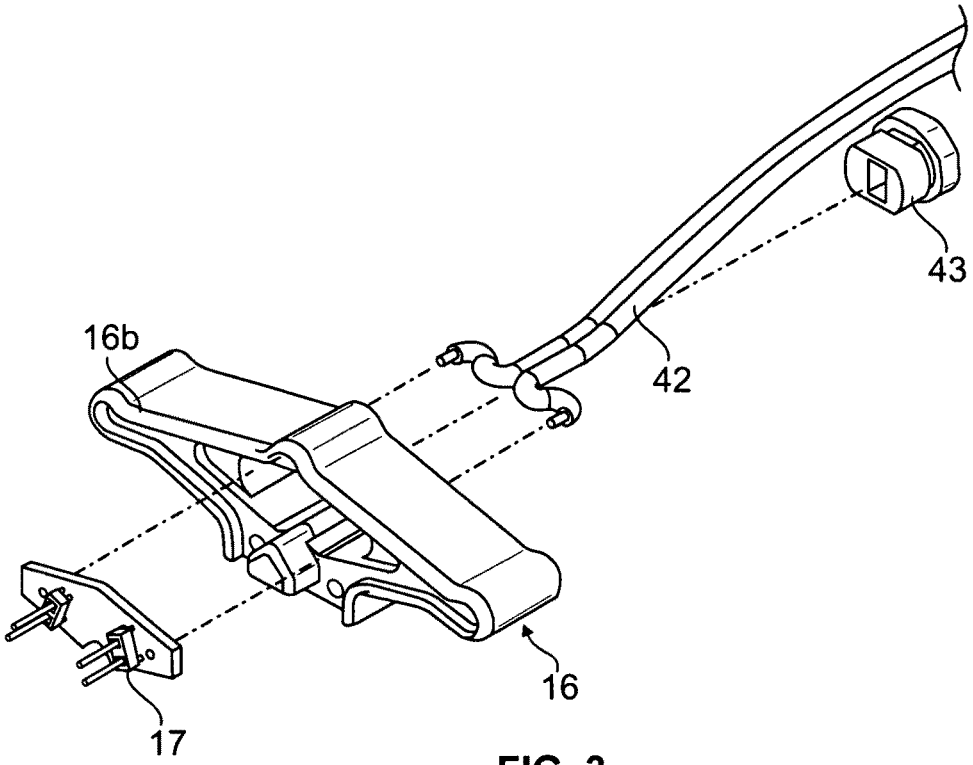
FIG. 3 is an exploded perspective view of an end cap of the light fixture.

Referring to FIGS. 1 and 3, the end caps 16 are removably affixed to the longitudinal ends of the frame 12 by at least one elongated connector 16*a*, such as a threaded fastener or pin. The frame 12 includes a recess 28*a* (see FIG. 2) that receives the uppermost connectors 16*a* for securement of the end cap 16 to the end of the frame 12. The end cap 16 has a flange 16*b* that overlaps an extent of the end portion of the frame 12. Alternatively, the flange 16*b* is omitted and a main body portion 16*d* of the end cap 16 is substantially planar. One of the end caps 16 includes an electrical connector 17, such as a male plug, for a power lead or cord 42, preferably universal alternating current (AC) input (such as 85-260 Volts, 47-63 Hertz), leading to a power supply. The end cap 16 may also have a securement nut 43 to secure the power cord 42 to the end cap 16 to prevent the power cord 42 from being accidentally pulled out of the end cap 16 thereby disconnecting the power supply from the fixture 10. Alternatively, the electrical connector 17 is omitted and the power cord 42 extends through the end cap 16 whereby the cord 42 is "hard-wired." In another embodiment, one of the end caps 16 includes either an aperture or a connector 17 for the power cord 42 and the other end cap 16 includes a connector 17 such that multiple fixtures 10 can be electrically interconnected without the use of additional external wires or leads. For example, a first fixture 10 includes a first connector 17 for the power cord 42 and a second end cap 16 with a female receptacle 17. A second fixture 10 includes a first end cap 16 with a male plug connector 17 that mates with the female receptacle 17 of the first fixture 10, whereby the first and second fixtures 10 are electrically interconnected for operation. The ability to directly interconnect the fixtures 10 without using separate leads or wires increases the versatility and utility of the fixture 10 since fewer components are necessary.

The fixture 10 includes at least one external power supply that can be utilized to power the fixture components without diminishing the fixture's "low-profile" configuration. Preferably, the power supply features universal input which allows the fixture 10 to be used in any electrical grid around the world. The power supply is a high-efficiency unit that provides constant current output (meaning direct current (DC)) in order to uniformly energize the LEDs 14. High-efficiency may be obtained by utilizing a switching type power supply design. The power supply may also have power factor correction capability and built-in electromagnetic interference (EMI) filtering to reduce and/or eliminate noise and distortion from the electrical grid. The fixture 10 may include a single power supply to power both groups of LEDs 14, or a power supply for each group of LEDs 14. The power supply may be an open frame type or an enclosed type with an outer frame or case, where the open frame type may include a coil. The power supply also provides constant current levels through a printed circuit board 50 to the LEDs 14 mounted to the PCB 50.

The fixture 10 includes two groups of multiple LEDs 14, wherein a first group of LEDs 14 is mounted to one of the support members 26 and a second group of LEDs 14 is mounted to the other support member 26. Because the support members 26 are angularly positioned, the grouping of LEDs 14 connected to the support members 26 are also angled from each other. Described in a different manner, and in contrast to conventional fixtures, the first group or array of LEDs 14 is angularly positioned with respect to the second group or array of LEDs 14, which enhances the range of light distribution without the need for additional lenses within the fixture 10. Preferably, the LEDs 14 are oriented substantially perpendicular to the support member 26, wherein a longitudinal axis 15 of the left LED 14 (representing the first group of LEDs) is substantially perpendicular to the respective support member 26 and a longitudinal axis 15*a* of the right LED 14 (representing the second group of LEDs) is substantially perpendicular to the respective support member 26. Each group of LEDs 14 extend along the length of the support member 26, and thus the length of the fixture 10. When the fixture 10 is vertically oriented, the LEDs 14 of one group may be horizontally aligned with the LEDs 14 of the second group, or horizontally misaligned such that a continuous line connecting the LEDs 14 of both groups is staggered. The longitudinal axis 15 of the left LED 14 (representing the first group of LEDs) intersects the longitudinal axis 15*a* of the right LED 14 (representing the second group of LEDs) to define a LED intersection angle $\theta$. The LED intersection angle $\Phi$ is a function of the support member internal arrangement angle $\theta$, where the sum of the LED intersection angle $\Phi$ and the internal arrangement angle $\theta$ equals 180 degrees. In the embodiment of FIG. 2, where the support member internal arrangement angle $\theta$ is approximately 60 degrees, the LED intersection angle $\Phi$ is approximately 120 degrees. Due to the angular positioning of the LEDs 14 and the arms 29, the fixture 10 provides a light range of approximately 180 degrees.

Figure 4A:
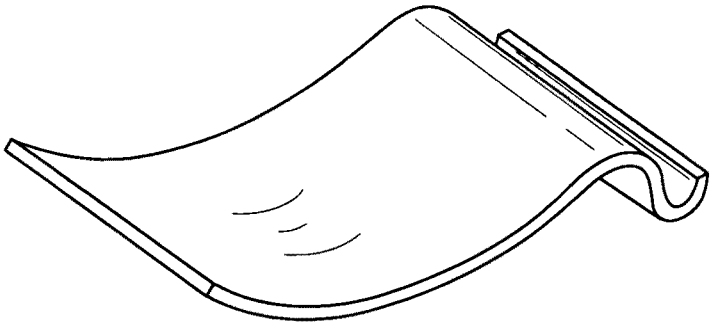
FIG. 4A is a perspective view of a tension clip used to secure the printed circuit board to the angled support member.
Figure 4B:
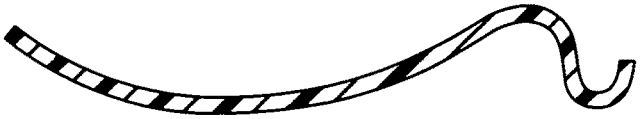
FIG. 4B is a cross-section of a tension clip used to secure the printed circuit board to the angled support member.

Referring to FIGS. 1, 2, 5 and 6 each LED 14 is electrically and mechanically mounted to a printed circuit board (PCB) 50 that is removably affixed to the support member 26. Preferably, the PCB 50 is received by a channel 35 of the angled support member 26. The PCB 50 is retained against the angled support member 26 using a tension clip 51 (shown in FIGS. 4A and 4B). The tension clip 51 has a flat edge 51*a* and a curved edge 51*b*. The flat edge 51*a* is designed to fit in the lower edge 35*a* of the channel 35, and the curved edge 51*b* of the tension clip 51 is designed to fit in the upper edge 35*b* of the channel 35. Because of the curvature of the tension clip 51 and the flexibility of the metal it is constructed from, the PCB 50 is securely pressed against the support member 26 to retain the PCB 50 in its position. Depending upon the length of the mullion, multiple LEDs 14 are mounted to a number of PCBs 50 secured to the angled support member 26.

The PCB 50 has a receiver 17*a* to receive the electrical connector 17. The receiver 17*a* creates an electrical connection between the power cord 42 and the copper trace running throughout the PCB 50. The LED 14 is surface mounted to the PCB 50 using a pair of mounting pins 52, 54 connected to the LED. The board 50 includes a copper trace between the receiver 17*a* and the LED 14. Thus, the copper traces 51 define a trace pattern that facilitates electrical connectivity across the PCB 50 and its components. A nylon bushing (not shown) may be positioned around the rear of the PCB 50 or the receiver 17*a* to function as an electrical insulator.

Within the PCB 50, current flows from the first pin 52 to the LED 14, across the LED 14, and then along the second mounting pin 54 back to the PCB 50, and then to a subsequent first pin 52 of another LED 14. If an LED 14 fails or upgrades are desired, the LEDs 14 can easily be removed to allow for the removal of the old LED 14 and installation of a replacement and/or upgraded LED 14. In one embodiment, the board 50 runs the entire length of the fixture 10 and a width of roughly 0.5 inch, and the LEDs 14 are warm white producing at least 30 Lumens (SI unit of luminous flux) per watt and with a color temperature ranging between 2,750 to 6,500 K and high color rendering index (CRI) of greater than 80. The CRI represents how a light source makes the color of an object appear to human eyes and how well subtle variations in color shades are revealed. The CRI is a scale from 0 to 100 percent indicating how accurate a "given" light source is at rendering color when compared to a "reference" light source, where the higher the CRI, the better the color rendering ability. In another embodiment, the board 50 may be limited to a length that is shorter that the length of the fixture 10. However, multiple boards 50 may be interconnected using the connector 17 to result in a length sufficient to cover the entire length of the fixture 10. In yet another embodiment, the fixture 10 includes fifteen (15) separate LEDs 14 positioned along each support member 26. One of skill in the art of LED fixture design recognizes that the number of LEDs 14 varies with the design parameters of the frame 12 and the support member 26. For example, a fixture 10 having a length of approximately 30 inches would have roughly one-half as many LEDs 14 mounted to each support structure.

The PCB 50 may be aluminum-clad or constructed from fiberglass. In the former construction, the aluminum-clad PCB 50 provides a thermal conductive path for heat generated by the LED 14 through the support member 26 to the rear legs 20 and the arms 29 for dissipation. In the latter construction where the PCB 50 is fiberglass (FR4), a thermally conductive interface element (not shown) is provided near the LED 14 to facilitate heat transfer to the support member 26 since fiberglass does not provide a thermal conductive path. Accordingly, a hole or aperture is formed in the fiberglass PCB 50 below the LED's 14 thermal slug to accommodate the interface element, which is in thermal contact with the LED 14 to facilitate heat transfer from an energized LED 14 to the support member 26. In general terms, the interface element 57 is thermally conductive but electrically insulating. Further, the interface element 57 is highly conformable and exerts a minimal amount of external stress upon the surrounding components, including the LED 14. During operation, heat generated by the LED 14 is transferred by the interface element through the PCB 50 to the support member 26 and then to the rear side support 20 and the arms 29 for dissipation. In one embodiment, the interface element is a generally circular pad formed from a low viscosity, non-electrically conductive gel or resin with high thermal conductivity and low thermal resistance properties. In another embodiment, the interface element is a thermally conductive liquid filler that is deformed to fill the void between the LED 14 and the support member 26 to which the PCB 50 is mounted. In either embodiment, the interface element does not exert measurable stress or force upon the LED 14. In another embodiment, the fiberglass PCB 50 includes a number of plated thru holes which reside under the LED 14 thermal slug, thereby acting a s "thermal vias" to transfer heat through the PCB 50. A thermal interface material is placed between the PCB 50 and the support member 26, which facilitates heat transfer from the lower portion of the PCB 50 to the support member 26, and also acts as an electrical insulator. This thermal interface material can be a die cut thermal pad, preferably round in shape, and large enough to cover or overlap the thermal vias in the PCB 50.

As evidenced by FIGS. 1-2, the fixture 10 includes a number of unique aspects. First, multiple LEDs 14 are electrically connected to a single PCB 50. Next, multiple PCBs 50 can be jointed to extend the substantially the length of the fixture 10. Connection points, connection pins 52, 54 and copper traces are utilized to electrically connect the various components, thereby eliminating the need for additional wires and connectors that increase the assembly time and build cost of the fixture 10. Furthermore, the two groups of LEDs 14 that are mounted on different planes provide a broader range of light than that provided by conventional fixtures having LEDs arranged in a single plane. The LEDs 14 are of the low wattage version, and may be Nichia NS6W083 or Citizen CL-820 or CL-822 LEDs.

Figure 5:
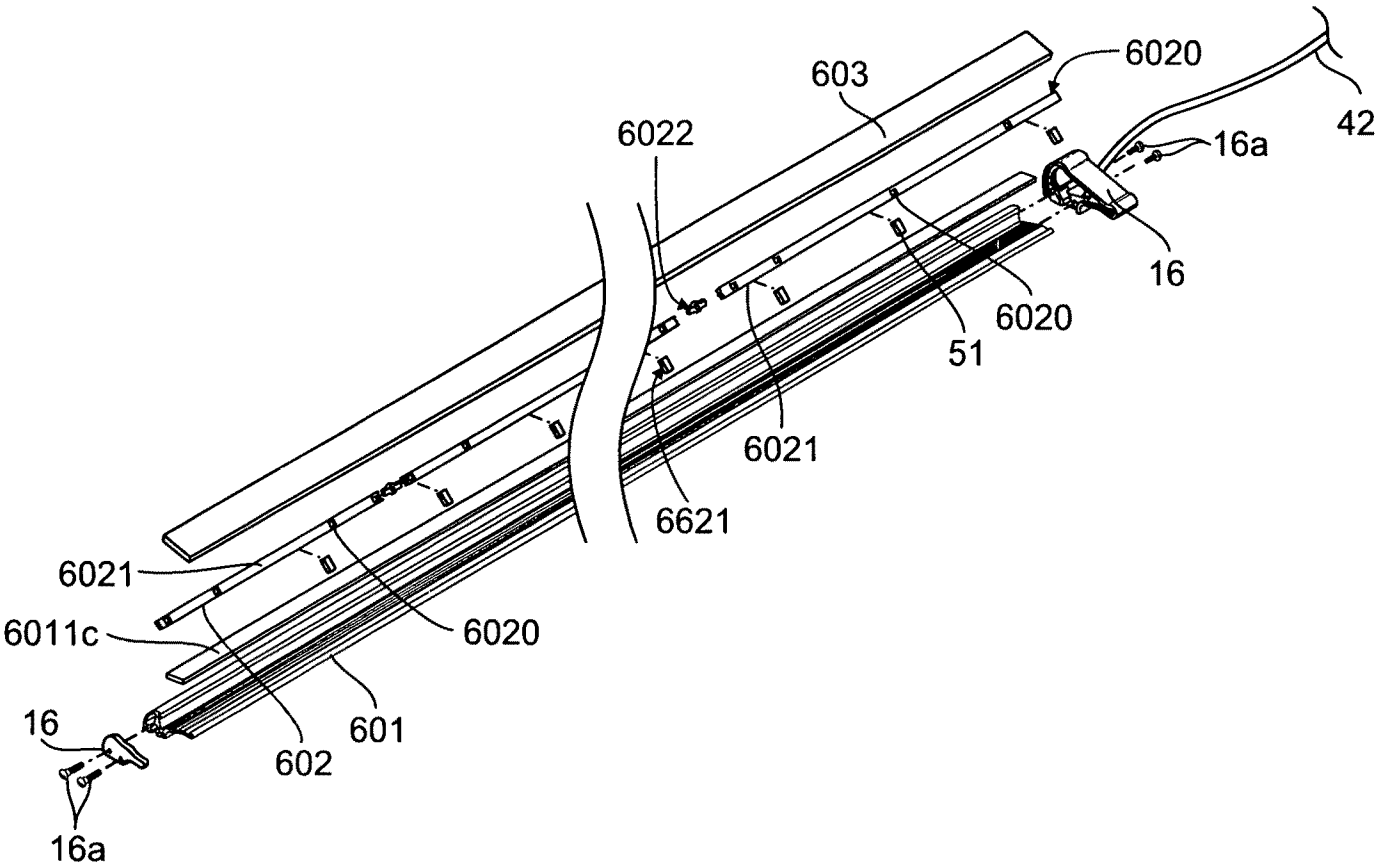
FIG. 5 is an exploded view of an alternate light fixture of the invention.
Figure 6:
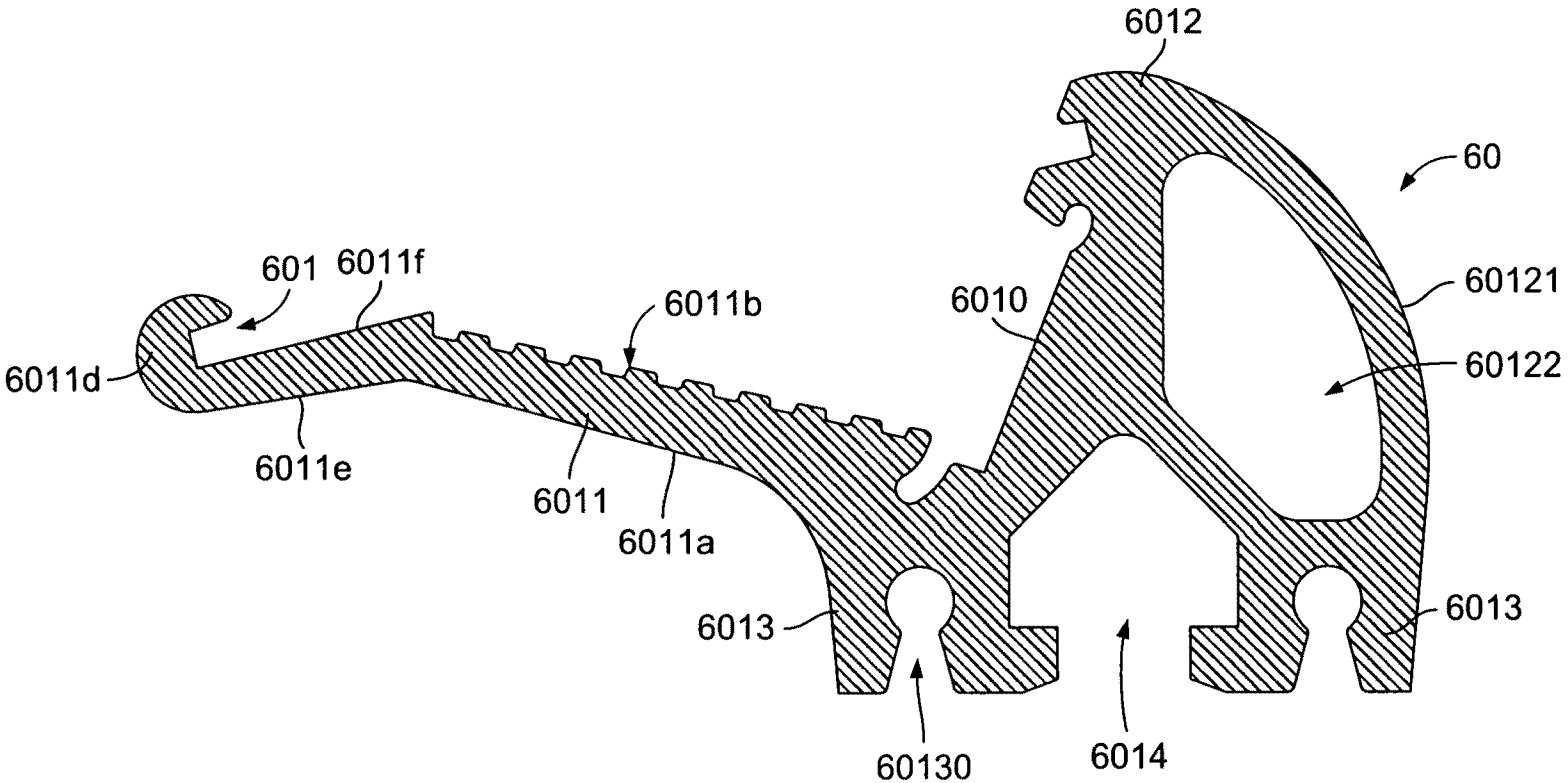
FIG. 6 is a sectional view of a frame of the alternate the light fixture of FIG. 5, showing a angled support member extending upward to form a peak; and, FIG. 7 is an exploded perspective view of an end cap of the alternate light fixture of FIG. 5.
Figure 7:
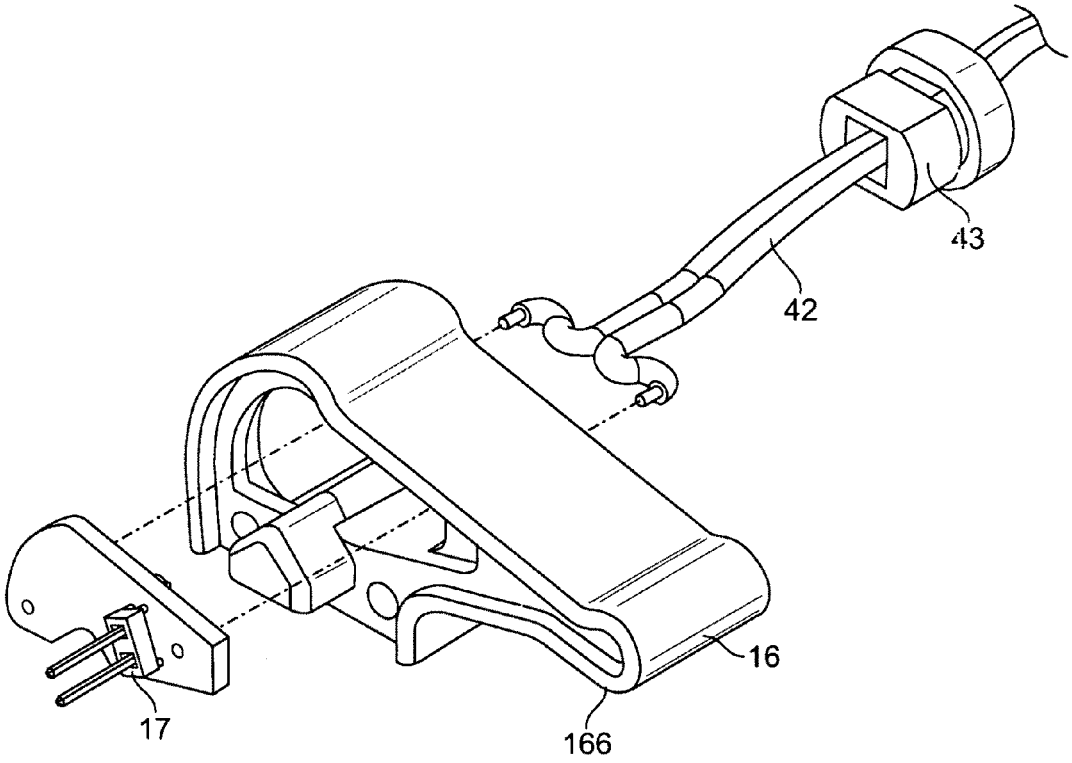

FIGS. 5-7 show an alternate LED fixture 60 configured to an existing corner frame member or end mullion within a display case or walk-in cooler, in a retrofit manner. The support assembly 60 includes an elongated support frame 601, an illumination assembly 602 comprised of at least one light emitting diode (LED) 6020 electrically and mechanically connected to a printed circuit board (PCB) 6021, and lens or cover 603. The support frame 601 includes a central hub 6010, an outwardly extending arm 6011 and a shoulder segment 6012. The shoulder 6012 includes a curvilinear outer edge 60121 and a interior aperture 60122 that extends along the longitudinal length of the frame 601. The arm 6011 and shoulder 6012 provide a reflecting surface for light generated by the LEDs 6020 through the lens 603 and into the refrigerated space in order to evenly illuminate the food and/or beverage products therein. Each arm 6011 includes a curvilinear lower surface 6011*a* and an upper surface 6011*b*, the latter of which provides a reflecting surface for light generated by the LEDs 14 through the cover 18 and into the refrigerated space in order to evenly illuminate the food and/or beverage products therein. The upper arm surface 6011*b* preferably has a notched surface to facilitate the connection of a reflecting surface 6011*c*, including a mirror panel. The upper arm surface 6011*a* and the reflecting surface 6011*c* are angularly oriented in a range of 0 to 60 degrees from horizontal, and is preferably 10-15 degrees from horizontal, and most preferably 12 degrees from horizontal. At an upper end portion or terminus 6011*d*, each arm 6011 includes a curvilinear receiver 6013 that receives a first edge 32 of a lens cover 18. Proximate the terminus 6011*d*, the lower surface 6011*a* includes a peripheral linear lower segment 6011*e* and the upper surface 6011*b* includes a peripheral linear upper segment 6011*f*, both of which are preferably inclined relative to the lower surface 6011*a* and upper surface 6011*b*. As shown in FIG. 5, the illumination assembly 602 includes multiple PCBs 6021 electrically joined inline by a connector 6022

Rear leg 6013 extends from the central hub 6010 and includes an elongated recess 60130 that receives a fastener to secure an end cap to the fixture 60. In the embodiment of FIGS. 8 and 9, the rear legs 6013 depend from the central hub 6010 to define a central cavity 6014 that is configured to receive a fastener for securement to the end mullion within the display case. Due to the inclined span of the arm 6011 and the shoulder 6012, the frame 601 has a "low-profile" configuration with an overall height OH that is 0.8 to 1 inch, preferably 0.8 to 0.9 inch, and most preferably 0.85 inch. Also, the frame 12 has an overall width OW (see FIG. 2), which is the distance between the outermost surface of the curvilinear receiver 601 and the outermost extent of the shoulder 6012, of 1.5 to 2 inches, preferably 1.75 to 1.85 inches, and most preferably 1.8 inches. Thus, the aspect ratio, meaning the ratio of the most preferred width to height of the fixture 60 is 1.8:0.85 or 2.17, which facilitates installation of the fixture 60 in the corner of the display case without interfering with its operation.

The LED fixtures 10, 60 may include a controller including a motion sensor, for example an optical sensor or an acoustical sensor, and/or temperature sensor, for example a thermocouple that measures the internal temperature of the refrigerated space within the display case. When the motion sensor detects the presence of people near the display case, then the controller increases the output of the LEDs 14. Similarly, when the motion sensor no longer detects the presence of people near the display case, then the controller decreases, either partially (e.g., dimming) or fully, the output of the LEDs 14. When the temperature sensor detects an internal temperature that exceeds a preset threshold, a controller linked to the sensor reduces the output of the LEDs 14 either partially (e.g., dimming) or fully, to increase the operating life of the LEDs 14. An example of this situation occurs when the compressor within the display case is shut off for maintenance of the case and the temperature within the case increases.

The LED fixtures 10, 60 may include a wired or wireless module, primarily a radio frequency control unit that allows for remote control of the illumination unit and/or the heating element. The radio frequency control unit can be factory assembled into the frame as original equipment, or added to the frame in the field by a service technician. In general terms, the radio frequency control unit allows an operator to remotely turn on, turn off, or adjust the illumination assembly of a single unit or a group of units to any desired brightness/output level. The remote interaction resulting from the control unit provides a number of benefits to the invention, including longer operating life for the components, lower energy consumption, and lower operating costs. The radio frequency control unit may also include high and low output switches or settings.

The radio frequency control unit comprises a number of components including a transceiver (or separate receiver and transmitter components), an antenna, and control interface for a power supply. The control interface includes a connector containing input signals for providing raw power to the control unit, as well as output signals for controlling the power supply itself. In operation, the control unit interacts with the power supply to allow an operator to power on, power off, or dim the brightness of the fixture. To ensure reception of the operating signals, the control unit utilizes an embedded antenna, or an external antenna coupled to the frame for better wireless reception. The radio frequency control unit can receive commands from a centralized controller, such as that provided by a local network, or from another control module positioned adjacent a mullion in close proximity. Thus, the range of the lighting network could be extended via the relaying and/or repeating of control commands between control units.

In a commercial facility or building having multiple refrigerated display cases or walk-in coolers, each inventive mullion may be assigned a radio frequency (RF) address or identifier, or a group of mullions are assigned the same RF address. An operator interfacing with a lighting control network can then utilize the RF address to selectively control the operation and/or lighting characteristics of all mullions, a group of mullions, or individual mullions (or display cases) within the store. For example, all mullions having an RF address corresponding to a specific function or location within the store, such as the loading dock or shipping point, can be dimmed or turned off when the store is closed for the evening. The operator can be located within the store and utilize a hand held remote to control the group of mullions and/or individual mullions. Alternatively, the operator may utilize a personal digital assistant (PDA), a computer, or a cellular telephone to control the mullions. In a broader context where stores are located across a broad geographic region, for example across a number of states or a country, the mullions in all stores may be linked to a lighting network. A network operator can then utilize the RF address to control: (a) all mullions linked to the network; (b) the mullions on a facility-by-facility basis; and/or (c) groups of mullions within a facility or collection of facilities based upon the lighting function of the mullions.

A centralized lighting controller that operably controls the mullions via the control units can be configured to interface with an existing building control system or lighting control system. The central lighting controller may already be part of an existing building control system or lighting control system, wherein the mullions and the control unit are added as upgrades. The radio frequency control unit could utilize a proprietary networking protocol, or use a standard networking control protocol. For example, standard communication protocols include Zigbee, Bluetooth, IEEE 802.11, Lonworks, and Backnet protocols.

Networked lighting controls, either radio frequency or hardwired, can be easily integrated into newly constructed devices such as refrigeration or freezer display cases when they are manufactured, due to economies, access, and technology in the manufacturing and assembly processes. It is impractical, economically, to integrate networked lighting controls, either RF or hardwired, into existing refrigeration or freezer display cases. Most existing refrigeration or freezer cases have only AC power connected to the units. Separate lighting controls could possibly be added to existing units, however, the complexity of retrofit, cost of installation, and limited functionality would be a deterrent. By embedding or integrating the radio frequency control unit directly into the fixture 10, the prohibitive costs of upgrading lighting systems in the field can be eliminated.

While the specific embodiments have been illustrated and described, numerous modifications come to mind without significantly departing from the spirit of the invention and the scope of protection is only limited by the scope of the accompanying Claims.

What is claimed is:

1. An elongated LED light fixture comprising:

an elongated housing including:

a substantially gap-free central hub extending longitudinally along the housing, the central hub having a pair of opposed integral support members, a pair of opposed, cantilevered arms extending laterally and at an upward angle from a lower portion of the central hub, wherein an end portion of each arm has a curvilinear configuration that defines a receiver, and at least one leg that extends downward from an area between the arm and the lower portion of the central hub;

a light engine including a printed circuit board and a plurality of LEDs electrically and mechanically connected to the printed circuit board, wherein the printed circuit board resides against the integral support member of the central hub; and, a lens cover extending between the receiver and an upper recess formed in the central hub above the internal support member.

2. The LED light fixture of claim 1, wherein the arm has an inner reflecting surface that is oriented 10 to 15 degrees from horizontal.

3. The LED light fixture of claim 2, wherein the inner reflecting surface is oriented 12 degrees from horizontal.

4. The LED light fixture of claim 1, wherein the rear leg includes a curvilinear terminal recess that is configured to engage a support surface.

5. The LED light fixture of claim 1, wherein the housing includes two legs, each leg extending downward from an area between the arm and the lower portion of the central hub.

6. The LED light fixture of claim 5, wherein the two legs are spaced a distance apart to define a rear central cavity that extends longitudinally along the housing, the rear central cavity being substantially aligned with the lower portion of the central hub.

7. The LED light fixture of claim 1, wherein the printed circuit board comprises a plurality of inline boards electrically joined by a connector.

8. The LED light fixture of claim 1, further comprising an external power supply electrically connected to the printed circuit board, wherein the fixture has a low profile configuration.

9. The LED light fixture of claim 1, wherein the support members are arranged in angled orientation with respect to a center line of the central hub.

10. The LED light fixture of claim 9, wherein the printed circuit board resides in an angled orientation with respect to a center line of the central hub.

11. The LED light fixture of claim 1, wherein the central hub includes a central post that defines an uppermost portion of the housing, the upper recess being formed in the central post.

12. An elongated LED light fixture comprising:

an elongated housing including:

a substantially cavity-free central hub extending longitudinally along the housing, the central hub having a pair of opposed integral support members and a central post that defines an uppermost portion of the housing, a first arm and a second arm extending at an angle from a lower portion of the central hub below the internal support members, wherein an end portion of each arm has a curvilinear configuration that defines a receiver, and at least one leg that extends downward from an area below the lower portion of the central hub;

a light engine including a printed circuit board and a plurality of LEDs electrically and mechanically connected to the printed circuit board, wherein the printed circuit board resides against the integral support member of the central hub; and, a first lens cover extending downward from a first side of the central post to the receiver of the first arm; and, a second lens cover extending downward from a second side of the central post to the receiver of the second arm.

13. The LED light fixture of claim 12, wherein the central hub and central post have a substantially triangular configuration in cross-section.

14. The LED light fixture of claim 13, wherein the housing includes two legs, each leg extending downward from a lower portion of the central hub.

15. The LED light fixture of claim 14, wherein the two legs are spaced a distance apart to define a rear central cavity that extends longitudinally along the housing, the rear central cavity being substantially aligned with the lower portion of the central hub.

16. The LED light fixture of claim 12, wherein the opposed internal support members are arranged in angled orientation with respect to a center line of the central hub.

17. The LED light fixture of claim 12, wherein the first side of the central post includes a first recess that receives a first end portion of the first lens cover.

18. The LED light fixture of claim 17, wherein the second side of the central post includes a second recess that receives a first end portion of the second lens cover.

19. The LED light fixture of claim 17, wherein an upper surface of the central post resides above an upper surface of the first lens cover.

20. The LED light fixture of claim 12, wherein the leg extends downward from the lower portion of the central hub and adjacent the first arm.

* * * * *